US006071225A

United States Patent [19]

Kucharski

[11] Patent Number: 6,071,225

[45] Date of Patent: Jun. 6, 2000

[54] SCORING RULE

[75] Inventor: Thaddeus W. Kucharski, Rochester, N.Y.

[73] Assignee: Dynamic Dies, Inc., Holland, Ohio

[21] Appl. No.: 09/097,229

[22] Filed: Jun. 12, 1998

[51] Int. Cl.[7] ..... B31B 1/25

[52] U.S. Cl. ..... 493/471; 493/472; 493/396

[58] Field of Search ..... 83/879, 887, 882, 83/346, 663; 493/59, 60, 63, 355, 363, 366, 367, 371, 471, 472, 396

[56] References Cited

U.S. PATENT DOCUMENTS

| | | | |
|---|---|---|---|
| 937,331 | 10/1909 | Reed | 83/663 |
| 1,577,620 | 3/1926 | Grammeter | 83/346 |
| 2,524,962 | 10/1950 | Dalsemer | 93/58 |
| 3,383,969 | 5/1968 | Saunders | 83/663 |
| 3,673,929 | 7/1972 | Saunders | 93/58.2 R |
| 3,884,132 | 5/1975 | Snodgrass | 93/59 MT |
| 3,919,924 | 11/1975 | Snodgrass | 93/59 R |
| 4,129,065 | 12/1978 | Corse | 93/58 ST |
| 4,289,492 | 9/1981 | Simpson | 493/371 |
| 4,373,929 | 2/1983 | Smith | 493/355 |
| 5,163,894 | 11/1992 | Ogawa | 493/468 |
| 5,194,064 | 3/1993 | Simpson et al. | 493/402 |
| 5,221,249 | 6/1993 | Simpson | 493/354 |
| 5,429,577 | 7/1995 | Simpson et al. | 493/354 |
| 5,509,885 | 4/1996 | Brunlid | 493/396 |
| 5,582,571 | 12/1996 | Simpson et al. | 493/355 |
| 5,641,551 | 6/1997 | Simpson et al. | 428/43 |
| 5,647,277 | 7/1997 | DeVito | 101/226 |

*Primary Examiner*—M. Rachuba
*Assistant Examiner*—Dominic Troiano
*Attorney, Agent, or Firm*—Brinks Hofer Gilson & Lione

[57] ABSTRACT

A resilient scoring rule for a rotary cutting die produces a creased or indented line in cardboard or paperboard along which line the board is subsequently folded when formed into a final product, such as a container. The scoring rule has a longitudinally extending, centrally disposed projecting web and opposed, cantilevered, symmetrical inwardly directed left and right ears having ends generally adjacent the central web. A pair of outwardly extending flanges raise the edge adjacent regions of the rule off the cutting die surface and function as mounting features which cooperate with staples or other retaining devices. An alternate embodiment scoring rule includes a pair of center projections or ribs flanked by a pair of cantilevered ears.

19 Claims, 2 Drawing Sheets

SCORING RULE

BACKGROUND OF THE INVENTION

The invention relates generally to rotary die apparatus for creasing or scoring cardboard or paperboard material used in the manufacture of cartons, boxes, point of purchase displays and the like and relates more specifically to an improved scoring rule for such rotary die apparatus.

Cutting dies for shaping and forming sheet material such as corrugated board can be flat or rotary. Rotary dies are used for their higher production rates. Such apparatus includes counter-rotating, horizontally disposed die and anvil cylinders mounted to a frame with a gap of predetermined thickness between them. Both the die and anvil cylinders are typically metal. The die cylinder carries a die board mounted thereon, with the appropriate cutting and scoring rules. A resilient urethane sleeve covers the anvil cylinder. As the corrugated blank is drawn between the cylinders, the cutting die, in cooperation with the anvil cylinder, cuts a blank from the sheet material and forms score-lines where the blank is to be folded.

The shape of the blank is laid out on a plywood die board including cuts, perforations, and fold lines. Saw or laser cuts are used to form slits which receive the cutting rules.

Some cutting die configurations require female dies on the anvil cylinder to align with the corresponding male dies on the die cylinder. Alignment is critical to quality and the die sets are costly to produce. This art is the subject of significant patent activity. U.S. Pat. No. 3,884,132 teaches a magnetic rule to align the female dies before affixing them to the anvil plate with pressure sensitive adhesive. U.S. Pat. No. 3,919,924 discloses a mechanical locator strip to align the female die. As preparation and alignment of the female die is costly, additional art provides for the elimination of the female die. U.S. Pat. No. 4,373,929 teaches separate cutting and scoring dies.

Cracking of the paperboard can be a significant problem. U.S. Pat. No. 5,221,249 addresses this issue by providing a rigid, undulating rule.

Variation in die board thickness led to the development of two different fields of art, cylinder contact rules and surface mount rules. U.S. Pat. No. 3,673,929 shows a scoring rule with metal flanges that project through slots in the die board and contact the metal die cylinder. Resilient scoring rules use the traditional surface mount method but flex in operation to compensate for die board variation. U.S. Pat. No. 4,289,492 discloses a scoring rule of plastic material having a longitudinally-extending ridge centrally located on the topside to form the score. U.S. Pat. No. 5,194,064 provides a complex set of creasing elements spaced laterally to produce a discontinuous score lines.

Finally, both U.S. Pat. Nos. 5,582,571 and 5,641,551 add teeth to the rule to create a controlled perforation to weaken the paperboard for folding.

SUMMARY OF THE INVENTION

A resilient scoring rule for a rotary cutting die produces a creased or indented line in cardboard or paperboard along which line the board is subsequently folded when formed into a final product, such as a container. The scoring rule has a longitudinally extending, centrally disposed projecting web and opposed, cantilevered, symmetrical inwardly directed left and right ears having ends generally adjacent the central web. A pair of outwardly extending flanges raise the edge adjacent regions of the scoring rule off the cutting die surface and function as mounting features which cooperate with staples or other retaining devices. An alternate embodiment scoring rule includes a pair of center projections or ribs flanked by a single pair of cantilevered ears. The scoring rule is most efficiently produced by the extrusion process.

It is therefore an object of this invention to provide an apparatus for scoring paperboard or cardboard stock and the like.

It is a further object of this invention to provide an apparatus for scoring paperboard or cardboard stock and the like without requiring a female die board.

It is a still further object of this invention to provide an apparatus for scoring paperboard or cardboard stock and the like that compensates for die board thickness variation.

It is a still further object of this invention to provide an apparatus for scoring paperboard or cardboard stock and the like which minimizes cutting, cracking or tearing of the stock, resulting in higher quality and less scrap.

It is a still further object of this invention to provide a method for scoring paperboard or cardboard stock and the like that may easily retrofit existing die boards.

Further objects and advantages of this invention will become apparent by reference to the following description of the preferred embodiment and appended drawings wherein like reference numbers refer to the same component, element or feature.

DESCRIPTION OF THE PREFERRED AND ALTERNATE EMBODIMENTS

Figure 1:
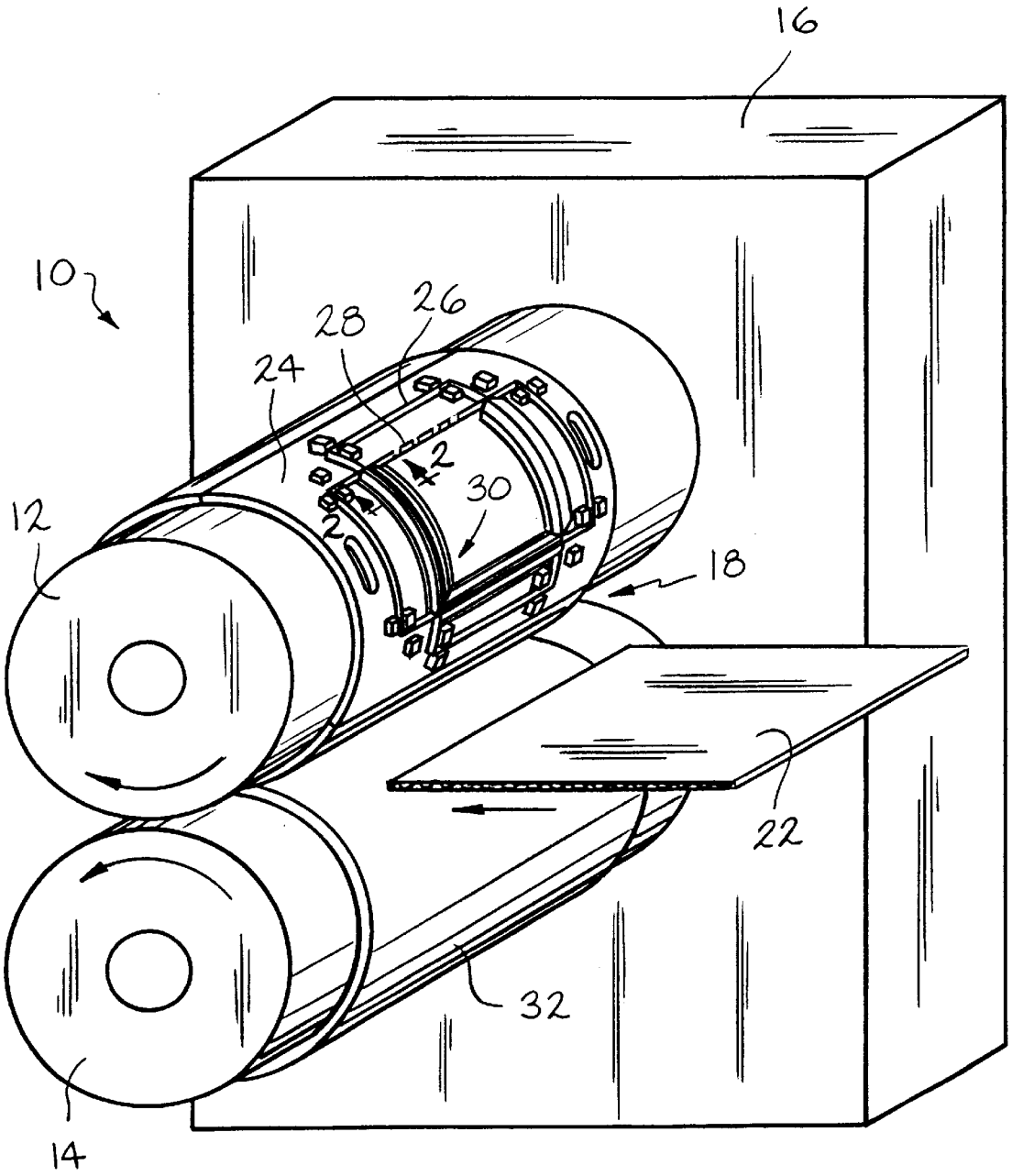
FIG. 1 is a diagrammatic, perspective view of rotary cutting die equipment employing the present invention.

Referring now to FIG. 1, a typical and representative rotary cutting die machine is diagramatically illustrated and generally designated by the reference number 10. The rotary cutting die machine 10 includes a die cylinder 12 and a counter-rotating anvil cylinder 14, both mounted for rotation on a frame 16 and rotated in synchronism by a suitable drive mechanism (not illustrated). The die cylinder 12 is positioned a precise distance from the anvil cylinder 14 and defines a nip 18 which receives paperboard or cardboard blanks or stock 22. Securely affixed to the die cylinder 12 by, for example, threaded fasteners (not illustrated) is a die board 24. The die board 24 typically includes a plurality of various cutting knives 26, perforating knives 28 and scoring rules or members 30 which are generally axially and circumferentially arranged and will be described subsequently.

The anvil cylinder 14 receives, mounts and is partially surrounded by a resilient sleeve or blanket 32. The blanket 32 functions as a stiffly resilient stop against which the cutting knives 26, perforating knives 28 and scoring members 30 operate as the die cylinder 12 and anvil cylinder 14 rotate and draw stock 22 through the nip 18. The blanket 32 is preferably of urethane material and is configured to allow its ready removal from the anvil cylinder 14 and its replacement.

As noted above, the die board 24 includes a plurality of generally axially and circumferentially arranged cutting knives 26. The cutting knives 26 define continuous knife edges which, when the cylinders 12 and 14 rotate, fully contact the blanket 32 and thus fully cut through the stock 22 along their lengths. As will be appreciated by reference to FIG. 1, the cutting knives 26 are disposed in a pattern on the die board 24 corresponding to the desired cut configuration of a final product. Similarly, the perforating knives 28 define alternating or discontinuous sections of full height knife blades which contact the blanket 32 and shallower or recessed portions which do not but which may extend partially through and cut a portion of the thickness of the stock or none at all. Depending on the desired or intended strength of the stock 22, the ratio of the portions of full cutting knives 26 to recessed, perforating knives 28 along a given line may be adjusted as needed as those familiar with these devices and processes will readily appreciate.

Figure 2:
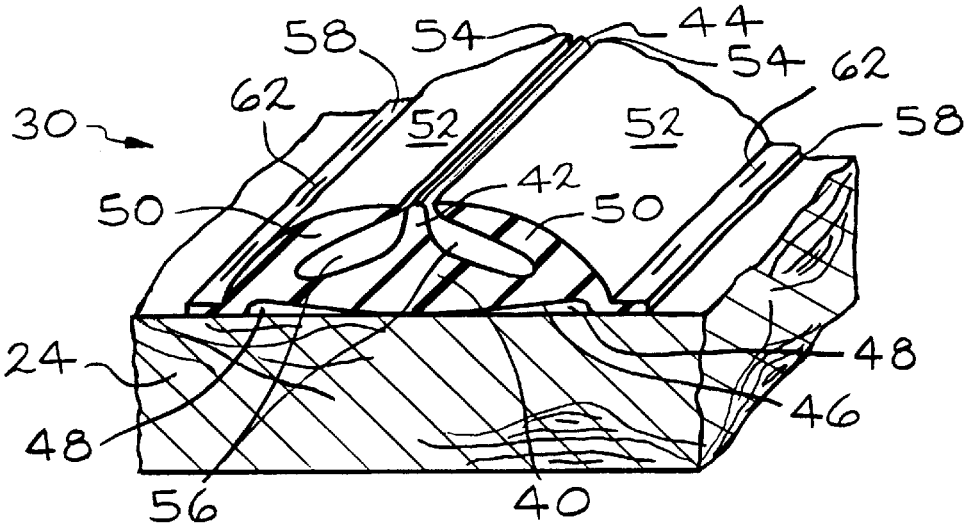
FIG. 2 is a fragmentary, perspective view of a scoring rule in accordance with the present invention affixed to a die board.
Figure 3:
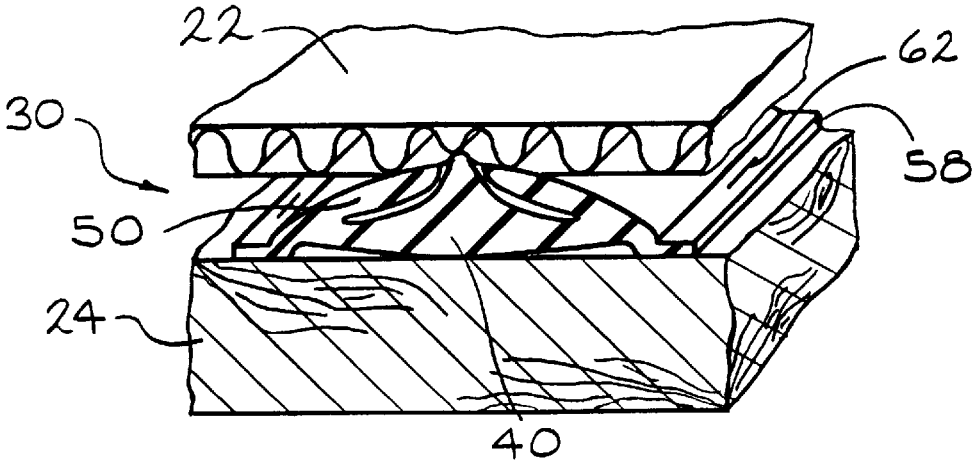
FIG. 3 is a fragmentary, perspective view of a scoring rule in accordance with the present invention affixed to a die board shown while engaging corrugated stock to form a score line.

Referring now to FIG. 1, 2 and 3, also secured to the die board 24 in a typically similar circumferential or axial disposition are the scoring rules or members 30. The scoring member 30 generally includes a central body portion 40 which defines a centrally disposed web or projection 42 forming a smoothly radiused central tip 44 and a generally convex lower surface 46. The convex lower surface 46, with the upper surface of the die board 24, defines a pair of opposed, narrow, generally triangular voids 48.

To the left and right of the web or projection 42 and disposed in mirror image symmetry are a pair of cantilevered fins or ears 50 having convex outer surfaces 52. The ears 50 define tips 54 which are spaced a short distance from the centrally disposed web or projection 42. In cooperation with the body 40, the ears 50 define a symmetrically disposed pair of oblong voids 56. Finally, the scoring member 30 includes a pair of symmetrically disposed outwardly extending, co-planar, parallel lips or flanges 58. The lips or flanges 58 preferably receive a plurality of spaced apart fasteners such as staples 62 or other similar fastening devices such as small screws, brads or the like which attach the scoring member 30 to the die board 24. Alternatively, the flanges 58 may be secured to the die board 24 by an adhesive.

Figure 4:
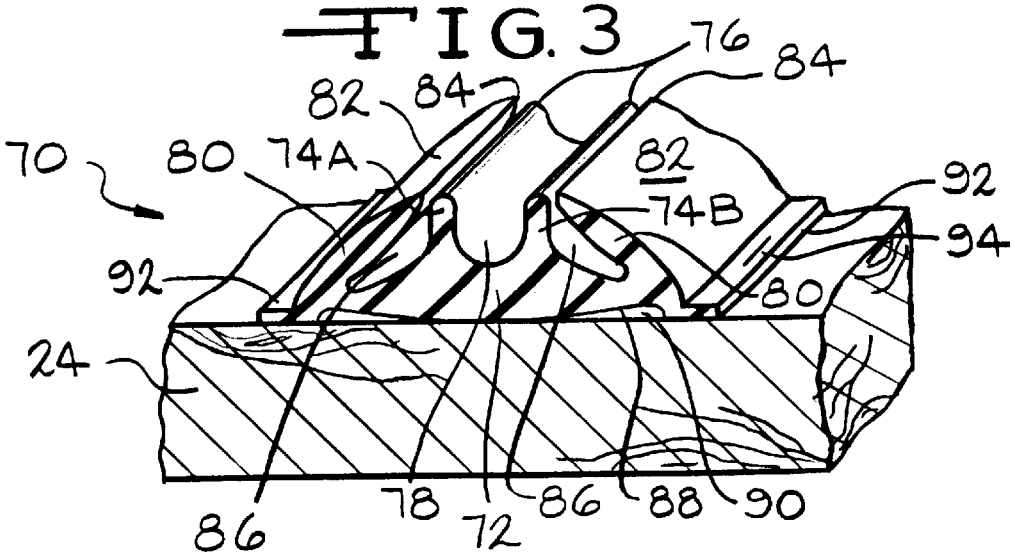
FIG. 4 is a fragmentary, perspective view of a first alternate embodiment scoring rule in accordance with the present invention.

Referring now to FIG. 4, a first alternate embodiment scoring rule or member 70 is illustrated. The first alternate embodiment scoring member 70 provides a parallel, double score or crease by virtue of a body 72 having a pair of parallel, spaced apart left and right webs or projections 74A and 74B, respectively, having smoothly radiused terminal portions or tips 76 separated by a smoothly curved reentrant channel 78. To the left of the left web or projection 74A and to the right of the right web or projection 74B and disposed in mirror image symmetry are a pair of inwardly directed, cantilevered fins or ears 80. The fins or ears 80 define convex outer surfaces 82 and tips 84 which are spaced a short distance from an adjacent one of the respective pair of webs or projections 74A and 74B. The body 70 and the fins or ears 80 define irregular voids 86 on one side of each of the projections 74A and 74B. The body 70 also includes a generally convex lower surface 88 which, with the upper surface of the die board 24, defines a pair of opposed, narrow, generally triangular voids 90.

Finally, the first alternate embodiment scoring member 70 includes a pair of symmetrical, outwardly extending, co-planar parallel webs or flanges 92. The webs or flanges 92 preferably receive a plurality of spaced-apart fasteners such as staples 94 or similar fastening devices such as small screws, brads or the like.

Both the preferred and alternate embodiment scoring members 30 and 70 are preferably fabricated of Santoprene, Grade 201-80, although a variety of different resilient materials such as rubber, synthetic rubber, EPDM and similar tough, resilient materials may be used. Santoprene is a trademark of Advanced Elastomer Systems, Inc. of Akron, Ohio. Preferably, both the preferred and alternate embodiment scoring rules or members 30 and 70 are extruded in indefinite lengths, cut to a desired length for a specific application and installed on a die board, such as the board 24.

The operation of the preferred embodiment scoring rule or member 40 will now be described, it being understood that the only significant operational difference between it and the first alternate embodiment scoring rule or member 70 is that it provides a single score or crease whereas the latter provides a double score or crease. When the corrugated cardboard or paperboard stock 22 is drawn into the nip 18 of the rotary die cutting apparatus 10 illustrated in FIG. 1, the tip of the projection 42 of the scoring member 30 contacts the surface of the paperboard stock 22 and forms the fold line as generally shown in FIG. 3. With prior art configurations, localized stresses in the stock 22 often exceeded its material properties and cracking and tearing occurred. The present invention overcomes this tendency by drawing more material to the loaded region of the paperboard and reducing localized stresses. Shortly after the scoring member projection 42 contacts the paperboard stock 22, the left and right surfaces 52 contact the stock 22.

As the load increases on the ears 50 they begin to flex into the voids 56, by virtue of the regions intermediate the body 40 and the ears 50 functioning as live hinges and they move closer to the scoring projection 42. The reduction of cross-sectional area of the body 40 achieved by the voids 48 assists this hinging action and also allows vertical compression of these regions against the die board 24. As they flex, the left and right surfaces 52 urge the surface layer of the cardboard or paperboard stock 22 towards the scoring projection 42. The result is a reduction in localized stress in the stock 22 at the creasing line and a corresponding reduction in cutting, tearing, cracking and scrap material. The alternate embodiment scoring rule or member 70 functions similarly, but, of course, provides two creases or indentations in the stock 22, one adjacent each of the projections 74A and 74B.

The foregoing disclosure is the best mode devised by the inventor for practicing this invention. It is apparent, however, that apparatus incorporating modifications and variations will be obvious to one skilled in the art of rotary die cutting machines. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. A scoring rule for a rotary die cutting machine comprising, in combination, an elongate member having a cross-section defining a body having a center portion, a pair of spaced-apart edge portions, a lower surface, and at least one central projection extending from said center portion in an opposite direction from said lower surface;

a pair of symmetrical cantilevered ears extending from said pair of spaced-apart edge portions terminating in tips disposed adjacent said at least one central projection; and a pair of mounting flanges extending outwardly from said pair of spaced-apart edge portions.

2. The scoring rule of claim 1 further including a die board and a means for fastening said pair of mounting flanges to said die board.

3. The scoring rule of claim 2 wherein said means for fastening is a plurality of staples.

4. The scoring rule of claim 1 wherein said body is generally triangular in cross-section.

5. The scoring rule of claim 1 wherein said scoring rule is fabricated of a resilient material.

6. The scoring rule of claim 1 further including a pair of voids defined between said body and each of said pair of symmetrical cantilevered ears.

7. The scoring rule of claim 1 wherein said at least one central projection is a pair of parallel, centrally disposed projections.

8. The scoring rule of claim 1 wherein said at least one central projection has a rounded tip.

9. A scoring member for a rotary die cutting machine comprising, in combination, a continuous elongate body;

at least one continuous projection extending from a central portion of said continuous elongate body and terminating in a tip;

a pair of continuous cantilevered ears extending from a pair of edge portions spaced on opposing sides of said central portion of said continuous elongate body, said cantilevered ears terminating in tips disposed adjacent said tip of said at least one continuous projection; and a mounting device adapted to secure said continuous elongate body to a die board.

10. The scoring member of claim 9 wherein said at least one continuous projection is a pair of parallel projections.

11. The scoring member of claim 9 further including a pair of voids defined between said continuous elongate body and each of said pair of continuous cantilevered ears.

12. The scoring member of claim 9 wherein said mounting device includes a pair of co-planar flanges.

13. The scoring member of claim 12 wherein said mounting device further includes staples extending through said pair of co-planar flanges.

14. The scoring member of claim 9 wherein said scoring member is fabricated of a resilient material.

15. The scoring member of claim 9 wherein said pair of continuous cantilevered ears having continuous tips disposed symmetrically on both sides of said at least one continuous projection.

16. The scoring rule of claim 9 wherein said tip of said at least one continuous projection is rounded.

17. A rotary cutting die for processing corrugated board, said die including a die plate and at least one creasing rule comprising a longitudinally extending continuous body having a central projection with a continuous tip on one side, a recessed cavity on an opposite side, a pair of continuous cantilevered ears extending from said continuous body from opposite edge portions spaced between said central projection and said recessed cavity, said pair of continuous cantilevered ears extending away from said edge portions directed toward said continuous tip, terminating in ends spaced proximate to, but on opposite sides of, said continuous tip.

18. A rotary cutting die of claim 17 wherein said pair of continuous cantilevered ears define a pair of continuous voids between said continuous body and each of said pair of continuous cantilevered ears whereby said cantilevered ears may deflect into said pair of continuous voids.

19. A rotary cutting die of claim 17 wherein said pair of continuous cantilevered ears have continuous ends disposed symmetrically on both sides of said continuous tip such to form a mirror image of the other at every point along said at least one creasing rule.

* * * * *